US006908083B2

(12) United States Patent
Pankhania

(10) Patent No.: US 6,908,083 B2
(45) Date of Patent: Jun. 21, 2005

(54) RECORDING PLATE OR FILM LOADING DEVICE

(75) Inventor: Jag Pankhania, Middlesex (GB)

(73) Assignee: Fujifilm Electronic Imaging Ltd., Harts (GB)

( * ) Notice: Subject to any disclaimer, the term of this patent is extended or adjusted under 35 U.S.C. 154(b) by 85 days.

(21) Appl. No.: 10/351,912

(22) Filed: Jan. 24, 2003

(65) Prior Publication Data

US 2003/0141656 A1 Jul. 31, 2003

(30) Foreign Application Priority Data

Jan. 25, 2002 (GB) ..... 0201725

(51) Int. Cl.[7] ..... B65H 1/00
(52) U.S. Cl. ..... 271/171; 271/240; 271/269
(58) Field of Search ..... 271/171, 267, 271/269, 240, 265.01, 239, 243, 249; 396/650; 347/264, 262; 346/138

(56) References Cited

U.S. PATENT DOCUMENTS 2,528,106 A 10/1950 Albrecht
3,542,359 A * 11/1970 Pilitz ..... 271/269
5,956,071 A * 9/1999 Mattila et al. ..... 347/262
6,342,914 B1 * 1/2002 Johnson et al. ..... 347/262
6,746,012 B2 * 6/2004 Diews ..... 271/164

FOREIGN PATENT DOCUMENTS

| | | |
|---|---|---|
| DE | 221 027 C | 4/1910 |
| DE | 367 696 C | 1/1923 |
| DE | 839 644 C | 5/1952 |
| EP | 0 822 454 A1 | 2/1988 |
| GB | 116 485 A | 6/1918 |
| WO | WO 99/17535 A1 | 4/1999 |
| WO | WO 00/49463 A1 | 8/2000 |

* cited by examiner

*Primary Examiner*—Donald P. Walsh
*Assistant Examiner*—Kaitlin Joerger
(74) *Attorney, Agent, or Firm*—Sughrue Mion, PLLC

(57) ABSTRACT

A recording plate or film loading device for use with an image recording scanner. The device comprises a platen (6) arranged at an angle to the horizontal and onto which a plate or film is manually placed. A loading mechanism includes one or more first pusher members (12) cooperating with the platen to push a plate or film to an output position. A centering mechanism includes a pair of second pusher members (13) movable laterally with respect to the platen (6) to centre a plate or film on the platen.

17 Claims, 5 Drawing Sheets

RECORDING PLATE OR FILM LOADING DEVICE

The invention relates to a recording plate or film loading device for use with an image recording scanner.

DESCRIPTION OF THE PRIOR ART

Modern image recording scanners have been developed which can record images onto a plate or film having dimensions up to 1200×1000 mm. By a recording plate or film we include any conventional imaging media such as photographic film, polyester plate, paper, aluminium plate etc. In some cases, a stack of unexposed plates or film sheets is provided in a cassette from which they are automatically loaded into the image recording scanner such as an internal drum imaging scanner (see for example EP-A-0822454). However, these cassettes are expensive and in many cases users prefer manually to load plates or films. This also has the advantage that successive images can be recorded on different size plates. In typical manual devices, a large, horizontal table is positioned adjacent the image recording scanner. The user places the unexposed film flat on the table and slides it towards an input opening on the scanner where it is picked up by feed rollers and fed into the scanner. A drawback of this is that it requires the user to have significant expertise in being able to orient correctly the film.

SUMMARY OF THE INVENTION

In accordance with the present invention, a recording plate or film loading device for use with an image recording scanner comprises a platen arranged at an angle to the horizontal and onto which a plate or film is manually placed; a loading mechanism including one or more first pusher members cooperating with the platen to push a plate or film to an output position; and a centering mechanism including a pair of second pusher members movable laterally with respect to the platen to centre a plate or film on the platen.

With this invention, we partially automate the manual feeding process by utilizing a special loading device provided with first and second pusher members which enable the plate or film to be correctly centred and then pushed at the correct speed into the image recording scanner. By mounting the platen at an angle to the horizontal, the plate or film will be maintained in contact with the first pusher member(s) under gravity thus ensuring that its position is accurately known. This angling also reduces the overall footprint of the device and reduces dust accumulation.

Although the pusher members could be manually operated, preferably the loading mechanism comprises a motor connected to the first pusher member(s) via a rack and pinion, typically mounted on a carriage running on linear tracks. This provides a simple implementation of the loading mechanism although other implementations will be readily envisaged by a person of ordinary skill in the art. For example, if more than one first pusher member is provided, each could be actuated by a respective motor.

Conveniently, the or each first pusher member includes a roller to assist lateral movement of the plate or film across the platen by the second pusher members. Thus, the roller would be pivoted to rotate in the lateral direction. Alternatively, the or each first pusher member could comprise a narrow edge across which the plate or film can be moved laterally or a low friction, flat surface.

Typically, the centering mechanism comprises a motor connected to the second pusher members via respective rack and pinion connections. As with the loading mechanism, other implementations of the centering mechanism are possible.

For semi-automatic implementations of the loading device, conveniently the centering mechanism includes a sensor for sensing engagement between the second pusher members and a plate. The sensor could monitor for the pressure exerted on the second pusher member by the plate in order to detect the presence of the plate but conveniently the sensor comprises an electrical circuit connecting the second pusher members and including a voltage source and current detector. This takes advantage of the fact that the plate will usually be electrically conductive.

Preferably, an inductive sensor is mounted to the platen to detect a metal plate on the platen. This provides further information about the presence of a plate.

Preferably, the device further comprises a control system for receiving information defining a plate or film size and for controlling the loading mechanism and centering mechanism so that the first and second pusher members take up positions corresponding to the defined size. The advantage of this is that placement of a film or plate of the incorrect size can be prevented since it becomes obvious to the user that the plate or film does not contact the pusher members correctly.

Typically, the platen is angled at 70–75°, preferably 71°, to the horizontal. This helps to prevent dust accumulation.

In order to prevent further dust accumulation, an air curtain or the like could be provided at the entrance to the image recording scanner. Furthermore, to reduce the risk of scratching of the sensitive surface of the plate or film, the platen may be covered by a suitable non-scratch material such as velvet.

BRIEF DESCRIPTION OF THE DRAWINGS

An example of a loading device according to the invention coupled to an internal drum image scanner will now be described with reference to the accompanying drawings, in which.

DESCRIPTION OF THE EMBODIMENTS

Figure 1:
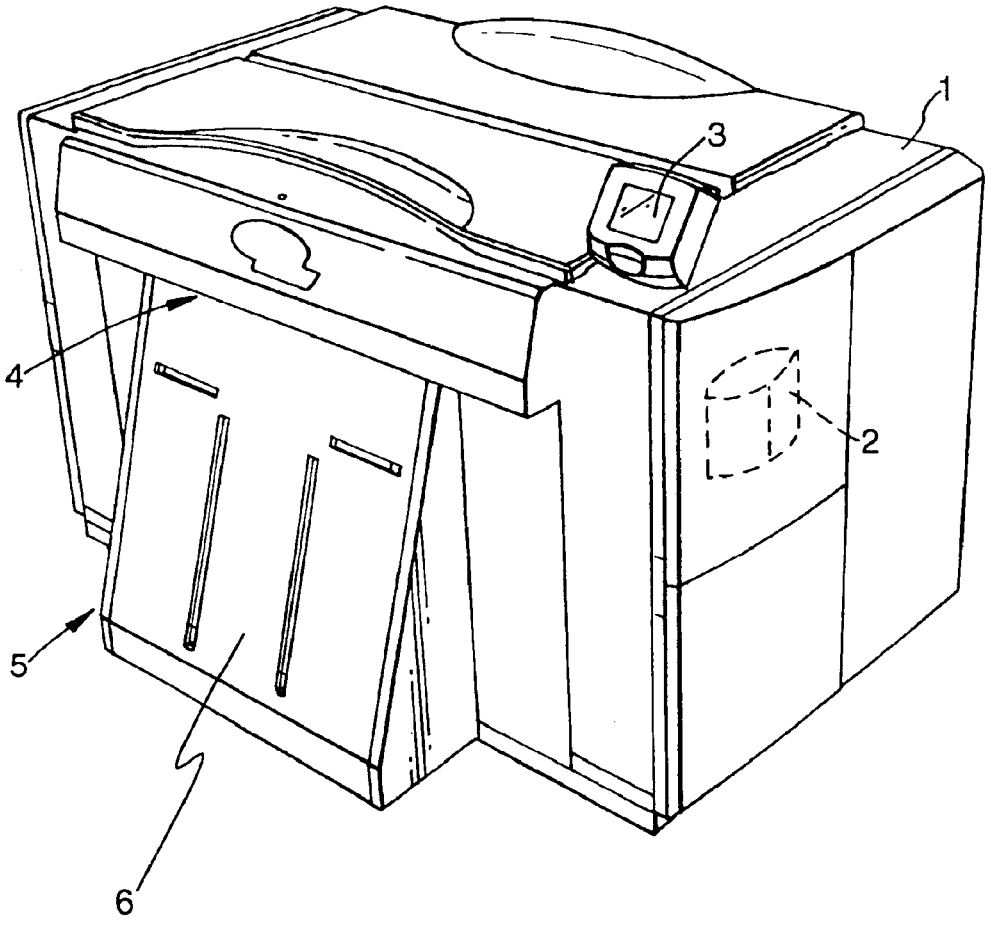
FIG. 1 is a perspective view of the loading device and scanner.

The apparatus shown in FIG. 1 comprises an internal drum image scanner 1 of conventional construction (for example as shown in WO-A-99/17535) having a control computer 2 mounted internally for controlling operation of the scanner. The control computer 2 is also connected to an illuminated control panel 3 mounted at the top of the scanner 1 for receiving inputs via a touch screen and displaying information. The scanner 1 has an input slot 4 for receiving individual plates or film sheets to be exposed.

Figure 2:
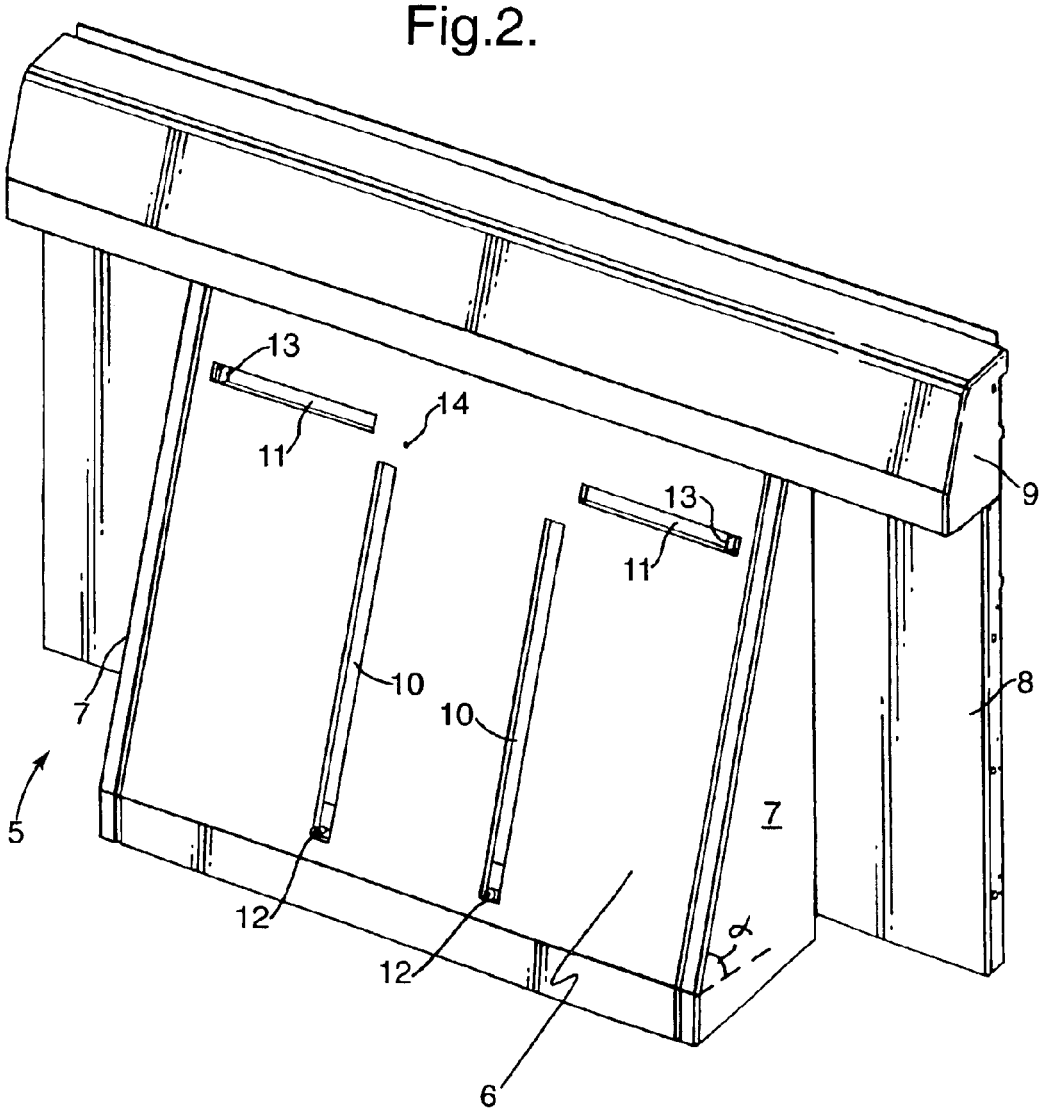
FIG. 2 is a front perspective view of the loading device.

A recording plate or film loading device 5 is mounted to the front of the scanner 1 and this is shown in more detail in FIG. 2. The device 5 comprises a platen 6 mounted at an angle $\alpha$ to the horizontal of 71°. The platen is mounted by means of side plates 7 to a back plate 8 and extends beneath an air curtain 9. A plate or film sheet exits from behind the air curtain 9 and passes into the slot 4.

The platen 6 has a pair of laterally spaced upwardly extending slots 10, and a pair of horizontally extending slots 11 towards its upper end. Protruding from each slot 10 is a respective first pusher member constituted by a roller 12, each roller 12 being mounted on an axle so that it is rotatable in the lateral direction. A pair of metal plates 13 defining second pusher members extends through respective slots 11.

Figure 3:
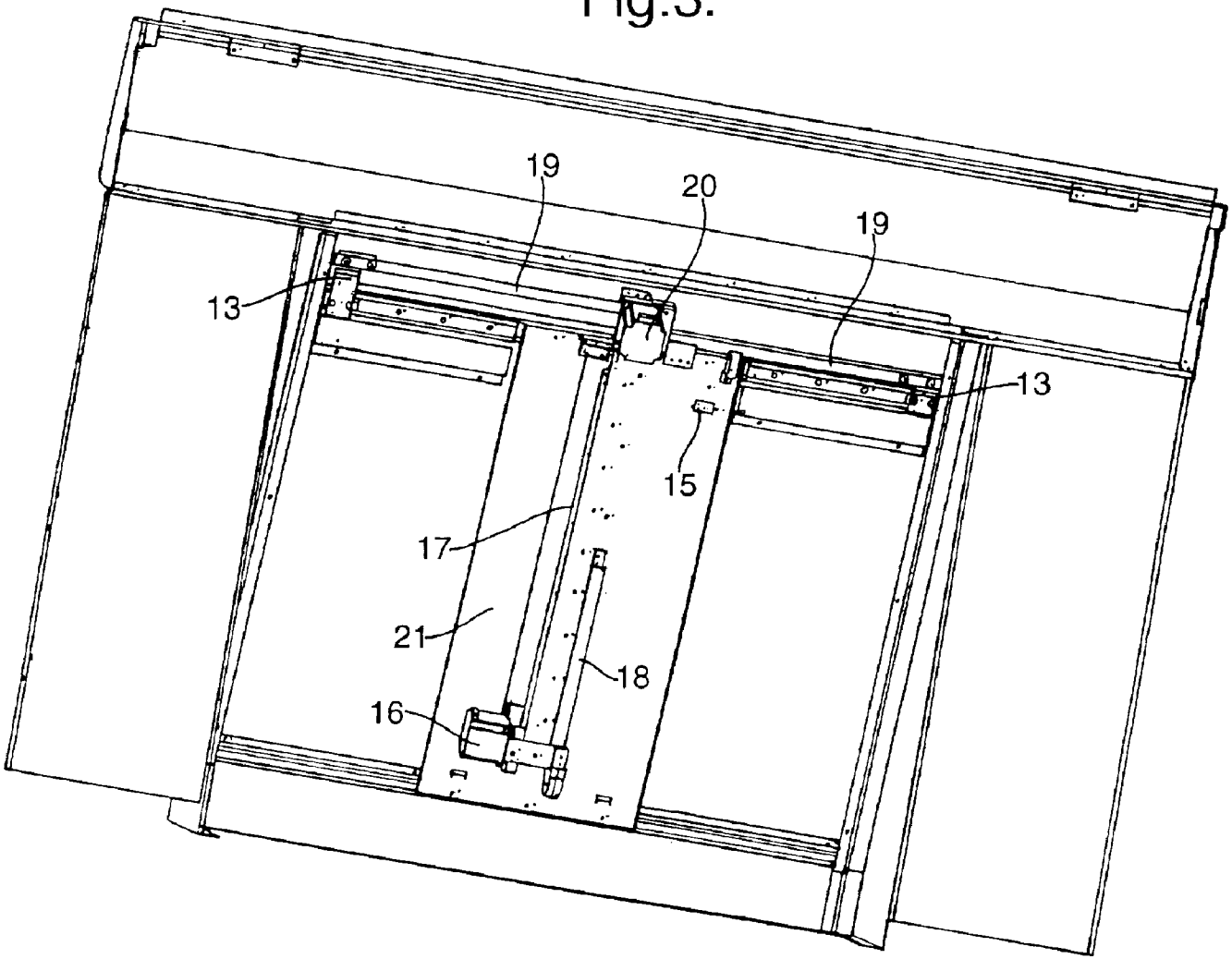
FIG. 3 is a rear perspective view of the loading device.

An infrared sensor 15 (FIG. 3) is mounted behind an aperture 14 in the platen.

Figure 4:
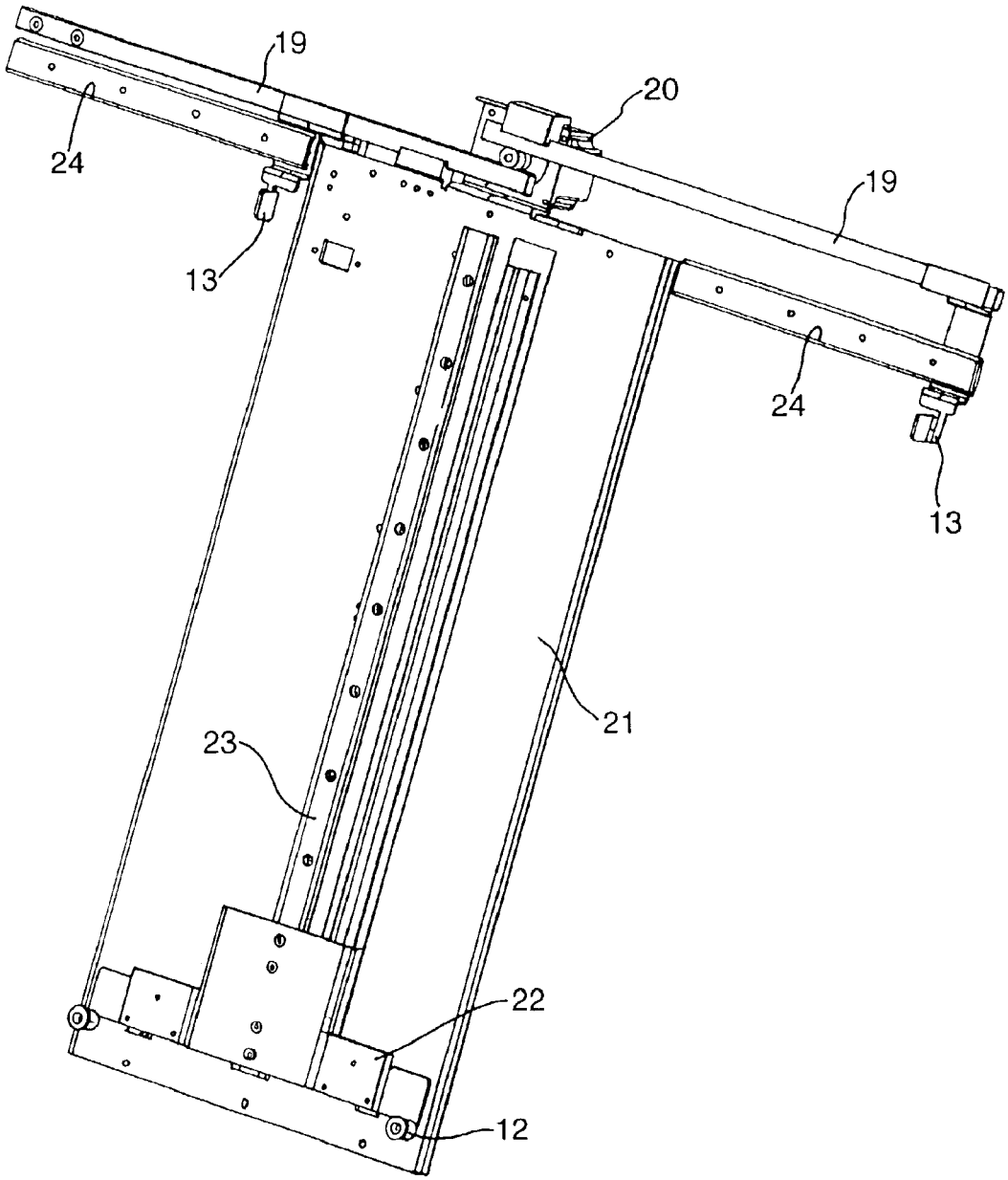
FIG. 4 is a perspective view of the front of the loading mechanism.

The first pusher members 12 are mounted on a carriage 22 (FIG. 4) which is slidable along a linear track 23. A stepper motor 16 is coupled to the carriage 22 and is mounted to a rack 17 fixed to a rear surface of the platen 21 (FIG. 3), the motor 16 being coupled to the rack 17 via a pinion (not shown). Power to the motor 16 is supplied though a ribbon cable 18 connected to a power source (not shown), the ribbon cable 18 also carrying control instructions from the control computer 2. When the motor 16 is activated, it rotates the pinion which runs along the rack 17 thus moving the carriage 22, motor 16 and pusher members 12.

The pusher members 13 are connected to respective racks 19 slidably mounted to the rear surface of the platen 21 and engaging opposite sides of a pinion (not shown) of a stepper motor 20. The stepper motor 20 is fixed to the platen 21 and connected (by means not shown) to a power supply and the control computer 2. When the stepper motor 20 is activated, the pusher members 13 will move along the slots 11.

Figure 5:
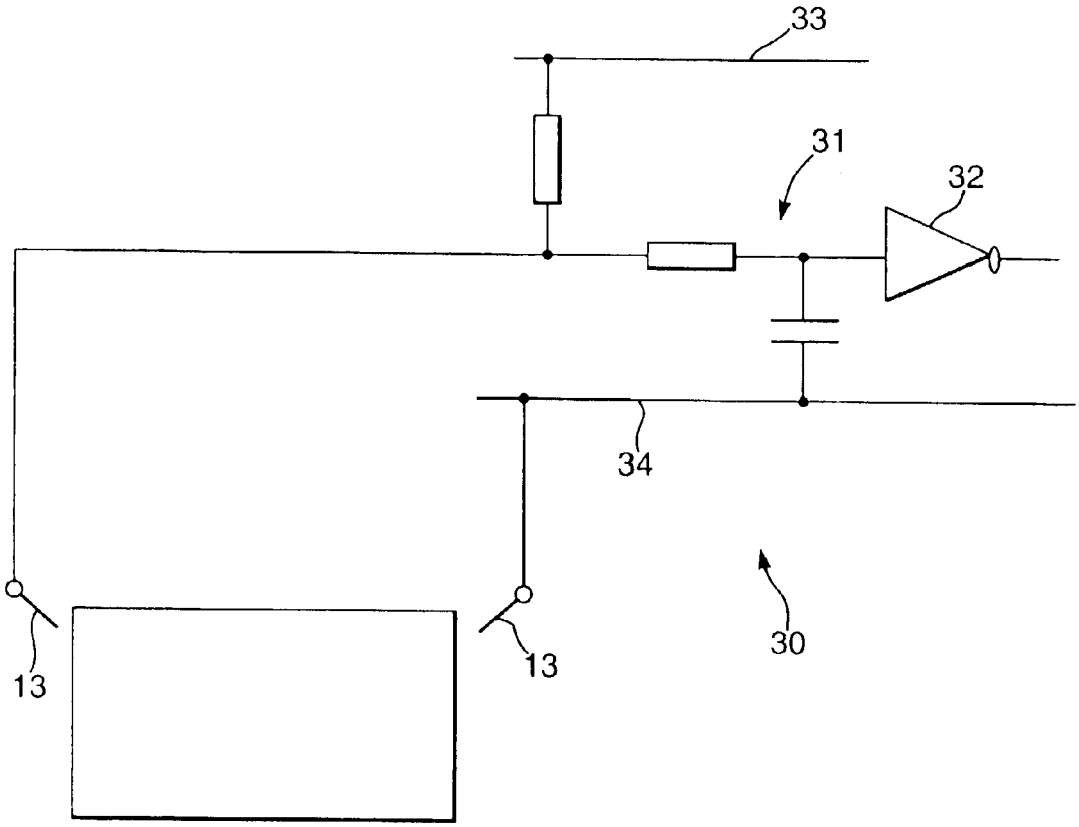
FIG. 5 is a circuit diagram of the lateral pusher member location detection circuit.

The pusher members 13 are connected into an electrical circuit 30 (FIG. 5), the electrical circuit also being coupled to the control computer 2. The pusher members 13 are connected across an RC circuit 31 whose output is fed to an inverting amplifier 32. One of the pusher members 13 is connected to a five volt line 33 while the other is connected to a ground line 34. When no plate is present between the pusher members 13, the input to the amplifier 32 will be high resulting in a logic low output whereas when the contacts 13 both contact a (electrically conductive) plate, the RC combination will be short circuited and the output from the amplifier 32 will be become high.

In use, when an operator wishes to record an image on a recording plate or film, he enters the dimensions of that film/plate via the control panel 3. Typical film/plate dimensions include a horizontal dimension of between 100 and 1200 mm and a "vertical" dimension of between 100 and 1000 mm. Typical thicknesses range from 0.1 to 0.3 mm.

Once the control computer 2 has received the dimensions, it then controls the motors 16,20 so as to locate the first and second pusher members 12,13 at positions at which they will just engage the sides of the film or plate.

The user then places a film or plate onto the platen 6. This placement will first be detected by the sensor 15 while in addition the circuit 30 containing the pusher members 13 will be completed when the plate/film is centred. All this information is received by the control computer 2 which will determine that a plate has been correctly located on the platen 6. Of course, for non-conductive media this automatic determination will not be possible unless, for example, an optical sensor has been provided.

Once the control computer 2 has ascertained that the correct medium has been placed on the platen 6, the motor 16 is actuated to move the sheet upwardly along the platen 6 at a speed suitable for it to be picked up by the feed rollers (not shown) of the input scanner 1 from where it is drawn into the scanner. The pusher members 12,13 are then returned either to a position previously determined for the next film or plate to be fed or to a default position. In the default position preferably it is not possible to load a film or plate onto the platen.

I claim:

1. A recording plate or film loading device for use with an image recording scanner, die device comprising a platen arranged at an angle to the horizontal and onto which a plate or film is manually placed; a loading mechanism including one or more first pusher members cooperating with the platen and actuable by a first stepper motor to push a plate or film to an output position; and a centering mechanism including a pair of second pusher members actuable by a second stepper motor for movement laterally with respect to the platen to centre a plate or film on the platen.

2. A device according to claim 1, wherein the fist pusher member(s) protrudes through an elongate aperture in the platen.

3. A device according to claim 1, wherein the first stepper motor is connected to the first pusher member(s) via a rack and pinion.

4. A device according to claim 3, wherein the rack is fixed behind the platen, the motor being movably mounted to the platen and connected to the pinion and the first pusher member(s).

5. A device according to claim 1, wherein the or each first pusher member includes a roller to assist lateral movement of the plate or film across the platen.

6. A device according to claim 1, wherein the second stepper motor is connected to the second pusher members via respective rack and pinion connections.

7. A device according to claim 6, wherein the motor is connected to the racks via a common pinion.

8. A device according to claim 1, wherein the centering mechanism includes a sensor for sensing engagement between the second pusher members and a plate.

9. A device according to claim 8, wherein the sensor comprises an electrical circuit connecting the second pusher members and including a voltage source and current detector.

10. A device according to claim 1, further comprising a control system for receiving information defining a plate or film size and for controlling the loading mechanism and centering mechanism so that the first and second pusher members take up positions corresponding to the defined size.

11. A device according to claim 1, further comprising an inductive sensor mounted to the platen to detect a metal plate on the platen.

12. A device according to claim 1, wherein the platen is angled at 70–75° to the horizontal.

13. A device according to claim 12, wherein the platen is angled at substantially 71° to the horizontal.

14. An image recording scanner coupled to a loading device, the device comprising a platen arranged at an angle to the horizontal and onto which a plate or film is manually placed; a loading mechanism including one or more first pusher members cooperating with the platen and actuable by a first stepper motor to push a plate or film to an output position; and a centering mechanism including a pair of second pusher members actuable by a second stepper motor for movement laterally with respect to the platen to centre a plate or film on the platen.

15. A scanner according to claim 14, the scanner comprising an internal drum image scanner.

16. A scanner according to claim 14, further comprising feed rollers located adjacent the output position of the loading device, to which a plate or film is fed in use by the loading device.

17. A scanner according to claim 16, wherein the first and second stepper motors are operable independently of the scanner.

* * * * *